US008113793B2

(12) United States Patent
Yu et al.

(10) Patent No.: US 8,113,793 B2
(45) Date of Patent: Feb. 14, 2012

(54) FAN

(75) Inventors: Po-Hao Yu, Taoyuan Hsien (TW); Chia-Chen Lee, Taoyuan Hsien (TW); Kun-Fu Chuang, Taoyuan Hsien (TW); Shun-Chen Chang, Taoyuan Hsien (TW)

(73) Assignee: Delta Electronics, Inc., Kuei San, Taoyuan Hsien (TW)

( * ) Notice: Subject to any disclaimer, the term of this patent is extended or adjusted under 35 U.S.C. 154(b) by 824 days.

(21) Appl. No.: 12/209,937

(22) Filed: Sep. 12, 2008

(65) Prior Publication Data

US 2009/0196770 A1 Aug. 6, 2009

(30) Foreign Application Priority Data

Feb. 1, 2008 (TW) ..... 97103928 A

(51) Int. Cl.
*F04B 35/04* (2006.01)
*H02K 7/09* (2006.01)
*H02K 21/12* (2006.01)

(52) U.S. Cl. ..... 417/354; 417/423.12; 417/423.14; 310/90; 310/90.5; 310/156.11; 310/156.12

(58) Field of Classification Search ..... 417/354, 417/423.12, 423.14, 423.17; 310/156.11, 310/156.01, 156.12, 67 R, 90, 90.5
See application file for complete search history.

(56) References Cited

U.S. PATENT DOCUMENTS

| | | | | |
|---|---|---|---|---|
| 6,511,303 | B2 * | 1/2003 | Obara | 417/423.12 |
| 2005/0140228 | A1 * | 6/2005 | Yeh et al. | 310/90.5 |
| 2005/0179327 | A1 * | 8/2005 | Horng et al. | 310/51 |
| 2008/0116756 | A1 * | 5/2008 | Chang et al. | 310/90 |

FOREIGN PATENT DOCUMENTS

| | | | |
|---|---|---|---|
| EP | 666424 | A1 * | 8/1995 |
| JP | 06205567 | A * | 7/1994 |
| JP | 2002034205 | A * | 1/2002 |

* cited by examiner

*Primary Examiner* — Mariceli Santiago
(74) *Attorney, Agent, or Firm* — Muncy, Geissler, Olds & Lowe, PLLC

(57) ABSTRACT

The present invention provides fan with an inrunner motor. The fan includes a fan frame, a rotor and a stator. The fan frame includes a base. The rotor includes a hub, a bushing and a magnetic member, wherein the magnetic member sleeves on the bushing. The stator is disposed on the base and coupled with the rotor, and the stator includes a shaft through the bushing, wherein an end of the shaft is fixed on the base.

21 Claims, 3 Drawing Sheets

FAN

BACKGROUND OF THE INVENTION

The Non-provisional applications claims priority under 35 U.S.C §119(a) on Patent Application No(s). 097103928, filed in Taiwan, Republic of China on Feb. 1, 2008, the entire contents of which are hereby incorporated by references.

FIELD OF THE INVENTION

The present invention relates to a fan and a motor thereof, and in particular to a fan having a motor capable of decreasing weight of the rotor and rotating inertia, and reducing size of the hub so as to increase the volume of the flow path.

DESCRIPTION OF THE RELATED ART

Nowadays, many apparatuses (such as fans) utilize motors to facilitate operation. Therefore, the quality of motors is also a key point in the quality of the apparatuses. In order to be competitive, the motor applied to the fan or other relative products needs to be designed with additional considerations to increase heat dissipating efficiency, to reduce vibration and noises and so on. If the above requirements are not achieved, noises will be produced, and the life span of the applied product will be reduced.

Referring to FIG. 1, a sectional view of a conventional axial fan is shown. The axial fan 1 is designed to have an outrunner motor. The axial fan 1 has an impeller consisting of a hub 13 and a plurality of blades 14 connected with the hub 13. The impeller is driven by the motor. The motor includes a stator 11 and a rotor. The rotor consists of a metal casing 15, a magnetic band 16 and a shaft 17. To operate the axial fan 1, the magnetic band 16 is disposed on an inner side of the metal casing 15, such that when the axial fan 1 is electrified, the stator 11 generating magnetic force pushes the magnetic band 16 and drives the impeller to rotate.

However, during the rotation of the impeller, rotating inertia is generated due to the shape of the motor, causing the axial fan 1 to vibrate during its operation. Thus, noises are produced and application in products requiring high stability is hindered.

Moreover, disposition of the metal casing 15 and the magnetic band 16 on the inner side of the hub 13 results in an increased-size hub 13. The hub 13 takes position in the airflow passage, narrowing the airflow passage of the fan and further reducing the heat dissipation efficiency thereof.

BRIEF SUMMARY OF THE INVENTION

Accordingly, the present invention provides a fan and a motor thereof to widen the airflow passage, increase heat dissipation efficiency, decrease rotating inertia, lower the noise, and extend the life span and raise the stability of the product.

Accordingly, the fan includes a fan frame, a rotor and a stator. The fan frame includes a base. The rotor includes a hub, a bushing and a magnetic member, wherein the magnetic member sleeves on the bushing. The stator, disposed on the base and coupled with the rotor, includes a shaft through the bushing, wherein an end of the shaft is fixed on the base.

The base includes a bottom wall, and a predetermined distance is kept between the bottom wall and an air outlet of the fan frame. The base further includes a side wall surrounding a periphery of the bottom wall to define a first accommodating space and a second accommodating space. A cross-section of the base along an axial direction forms an H-shaped structure. The fan further includes a circuit board received in the first accommodating space. The stator is received in the second accommodating space. The bottom wall includes a protrusion extended from the bottom wall toward the air outlet of the fan to connect with the circuit board. Otherwise, a fastening structure is utilized to abut the circuit board in the first accommodating space.

Preferably, the end of the shaft is embedded in the protrusion, and an other end of the shaft includes a groove for a fastener to be engaged.

A plurality of ribs are formed between the base and an exterior wall of the fan frame, and the connector extends upwardly. A plurality of blades are formed around the hub and extends upwardly. Preferably, bottom peripheries of the blades extend axially toward the air outlet of the fan and exceed a top periphery of the side wall of the base.

The magnetic member is a permanent magnet, and the bushing includes metal.

The fan further includes at least one bearing disposed in the bushing. A periphery is formed on center of a top surface of the hub to define a recess, and the shaft is received in the recess.

The stator further includes at least one silicon steel wound by coils or a bobbin wound by coils, all of which are disposed around the magnetic member. Otherwise, the stator further includes a coil and a metal casing covering the coil, wherein the coil is fixed on a rack. The fan is an axial fan.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

First Embodiment

Figure 1:
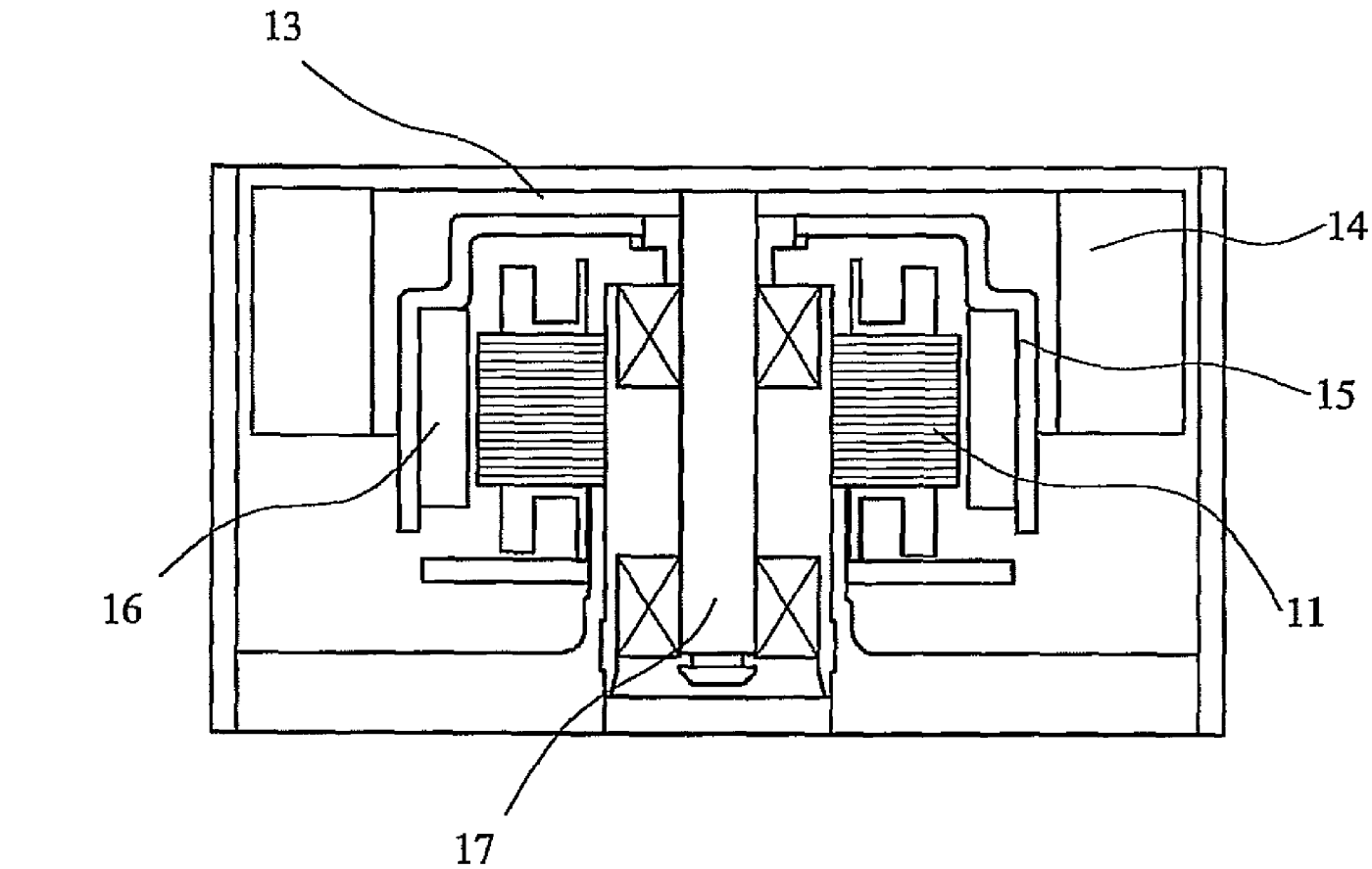
FIG. 1 ( PRIOR ART )
FIG. 1 is a sectional view of a conventional axial fan.
Figure 2:
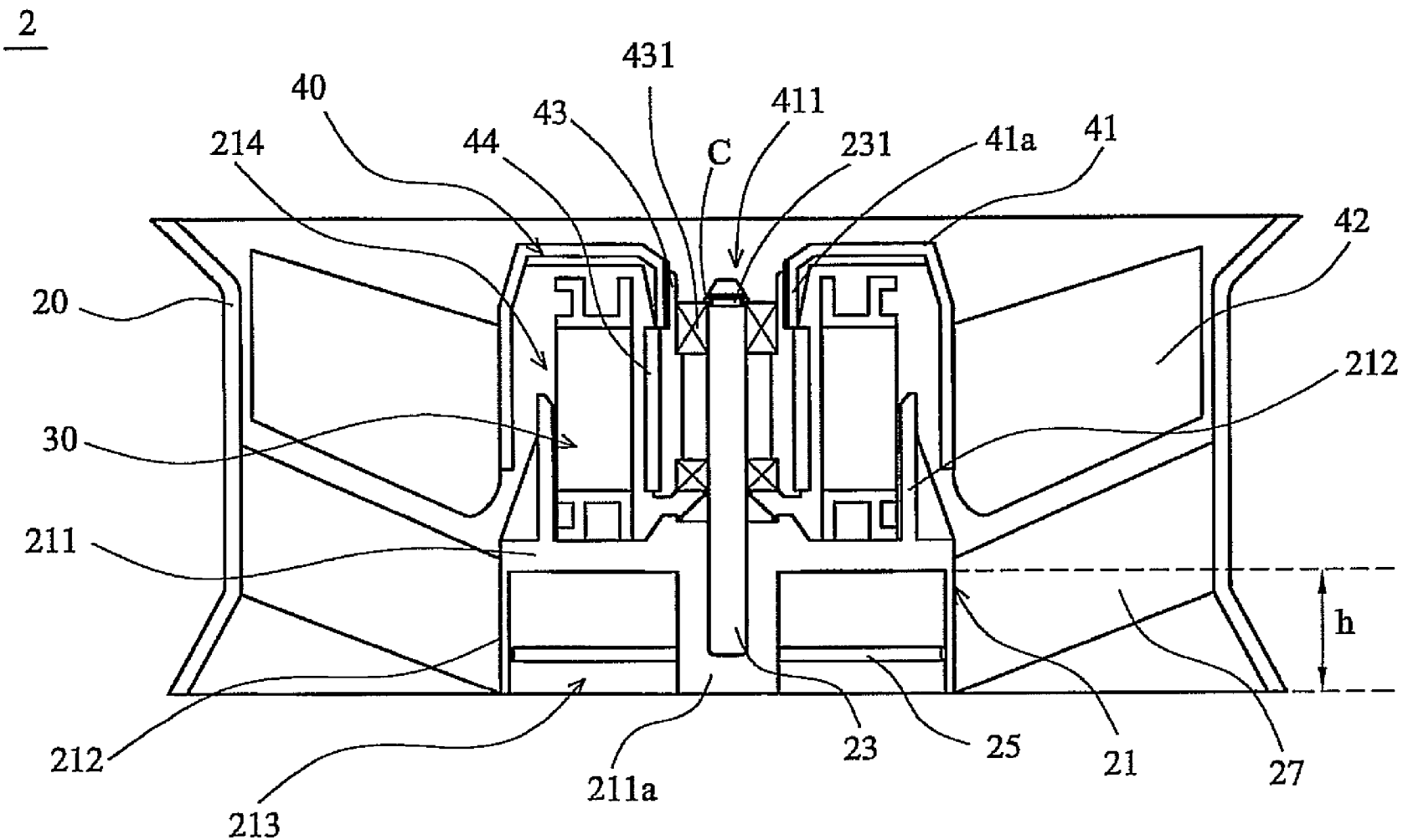
FIG. 2 is a schematic view of a fan according to a first embodiment of the present invention.

Referring to FIG. 2, a schematic view of a fan according to a first embodiment of the present invention is shown. The fan 2 includes a fan frame 20, a stator 30 and a rotor 30. The fan frame 20 includes a base 21, and the stator 31 is placed on the base 21. The stator 30 has a shaft 23 disposed on the base 21, wherein one end of the shaft 23 is embedded or covered in the base 21, and extends toward an air inlet of the fan 2. Additionally, the other end of the shaft 23 has a groove 231 for engaging with a fastener "C".

The stator 30 includes at least one silicon steel or a bobbin wound by coils, all of which are disposed around the magnetic member. The rotor 40 includes a hub 41, a bushing 43 and a plurality of blades 42. A protruding periphery is formed on the center of a top surface of the hub 41 to define a recess 411. The bushing 43 is made by metal and the bushing 43 is connected with the recess 411. There is at least one bearing 431 disposed in the bushing 43, and there is further a magnetic member 44, such as a permanent magnet, disposed outside the bushing 43. When the fan 2 is in operation, the shaft 23 moves relate to the bushing 43, the bearing 431 and the magnetic member 44 of the rotor 40.

The base 21 includes a bottom wall 211 and a side wall 212. The side wall 212 surrounds a periphery of the bottom 211, and a predetermined distance "h" is kept between the bottom wall 211 and an air outlet of the fan frame 20, so that a cross-section of the base 21 along an axial direction forms an H-shaped structure. The bottom wall 211 is presented as a demarcation. The portion below the bottom wall 211 is defined as a first accommodating space 213, and the portion above the bottom wall 211 is defined as a second accommodating space 214. The first accommodating space 213 receives a circuit board 25, and the second accommodating space 214 receives the stator 30. The stator 30 is electrically coupled to the circuit board 25 to be driven.

The bottom wall 211 includes a protrusion 211*a* which extends from the bottom wall 211 toward the air outlet of the fan frame 20. The end of the shaft 23 is embedded in the protrusion 211*a* to intensify the connection between the shaft 23 and the bottom wall 211. The circuit board 25 is received in the first accommodating space 213 and the circuit board 25 has a center opening for allowing the circuit board 25 to be fixed on the periphery of the protrusion 211*a*.

During assembly, the end of the shaft 23 penetrates through the bearing 431 with the bushing 43 and is fixed on the base. A fastener "C", such as a C-shaped ring, engages with a groove 231 on the other end of the shaft 23 at the air inlet of the fan 2. The outer perimeter of the fastener "C" is slightly greater than the outer perimeter of the shaft 23, such that the bearing 431 within the bushing 43 is blocked by the fastener "C", preventing the shaft 23 from shifting axially in order to limit the movement of the shaft. The above design provides a fan 2 with easy assembly and disassembly. During operation, heats generated by the fan 2 are able to be dissipated through the recess 411 of the hub 41, extending the life span of the fan 2.

In the embodiment, because the magnetic member 44 of the fan 2 is disposed outside of the bushing 43, the weight of entire rotor 40 is centralized, and the diameter of the hub is accordingly decreased. Therefore, rotating inertia is substantially decreased, the vibration is reduced, and the noise is restrained during the operation of the fan 2.

Moreover, the airflow passage is enlarged to provide more space to let airflows pass through. A fan with a diameter of 40 mm, for example, may have a hub, normally with a diameter of 23 mm, to be reduced downward to 21 mm, without amending other components disposed within the fan 2. Therefore, the airflow passage is able to be enlarged to increase the space for airflows to pass, enhancing heat dissipation efficiency.

Additionally, in order to have a better result for reducing noise, the ribs 27 between the fan frame and the base 21, and the blades 42 are both designed to extend upwardly, restraining the pneumatic noise and upgrading the efficiency of the fan. Furthermore, the bottom peripheries of the blades 42 extend along an axial direction toward the air outlet of the fan and exceed a top periphery of the side wall 212 of the base, so that the size of the blades is increased, raising air volume produced.

Second Embodiment

Figure 3:
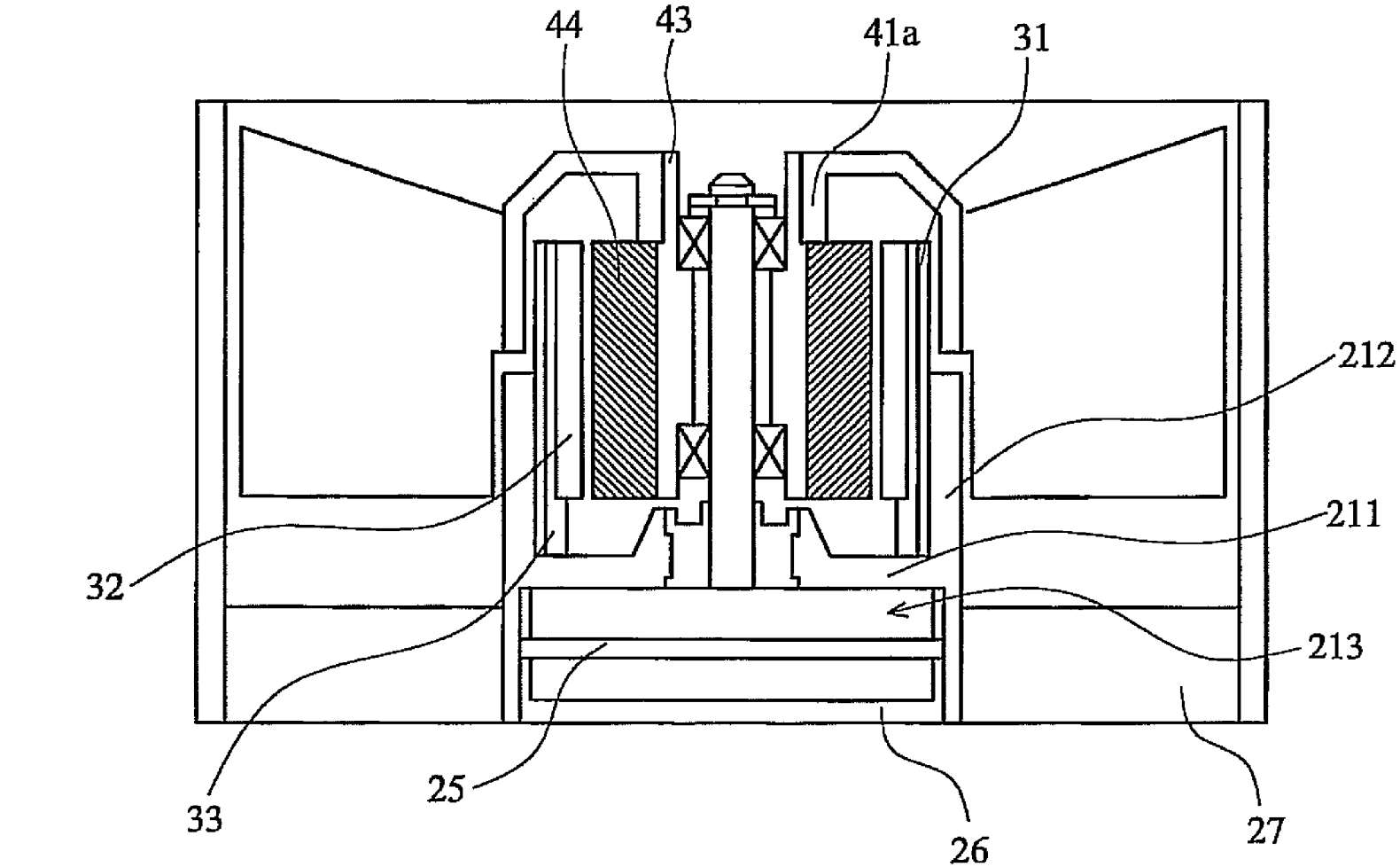
FIG. 3 is a schematic view of a fan according to a second embodiment of the present invention.

The variation of the fan of the invention is not limited. Referring to FIG. 3, a schematic view of a fan according to a second embodiment of the present invention is shown. The stator of the fan 3 can be varied according to requirements. The structure of this embodiment is substantially the same as that of the previous embodiment. It differs in that the stator has a metal casing 31, and a coil 32 is disposed between the metal casing 31 and the magnetic member 44 to achieve the same effect of the previous first embodiment. The coil 32 is fixed on a rack 33 so as to be disposed within the metal casing 31. Besides, the bottom wall 211 does not have a protrusion, and a circuit board 25 without an opening is provided. The circuit board 25 is disposed in the first accommodating space 213 by being abutted with the at least one fastening structure. As a result, the center of the circuit board 25 does not require an additional opening, the area of the circuit board 25 can be fully utilized to assemble more components and heat dissipation efficiency of the circuit board 25 is raised.

As described, the fan of the present invention substantially lowers the rotating inertia, efficiently reduces noise, and widens the airflow path to enhance heat dissipation efficiency. The design can apply to variant fans, especially an axial fan, to elaborate its unique characteristics.

While the present invention has been described by way of example and in terms of preferred embodiment, it is to be understood that the present invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan, comprising:

a fan frame comprising a base, the base comprising a bottom wall and a side wall, wherein a predetermined distance is kept between the bottom wall and an air outlet of the fan frame, and the side wall surrounds a periphery of the bottom wall so as to define a first accommodating space and a second accommodating space;

a rotor comprising a hub, a bushing and a magnetic member sleeving on the bushing;

a stator disposed on the base, received in the second accommodating space, and coupled with the rotor, the stator comprising a shaft through the bushing, wherein an end of the shaft is fixed on the base;

a circuit board received in the first accommodating space; and a fastening structure abutting the circuit board in the first accommodating space.

2. The fan as claimed in claim 1, wherein a cross-section of the base along an axial direction forms an H-shaped structure.

3. The fan as claimed in claim 1, wherein the bottom wall comprises a protrusion extended from the bottom wall toward the air outlet of the fan to connect with the circuit board.

4. The fan as claimed in claim 3, wherein the end of the shaft is embedded in the protrusion.

5. The fan as claimed in claim 1, further comprising at least one bearing disposed in the bushing, and an other end of the shaft comprises a groove.

6. The fan as claimed in claim 1, wherein another end of the shaft comprises a groove.

7. The fan as claimed in claim 6, further comprising a fastener, wherein after the shaft penetrates the bushing, the fastener engages with the groove.

8. The fan as claimed in claim 1, wherein a plurality of ribs are formed between the base and an exterior wall of the fan frame and extending upwardly.

9. The fan as claimed in claim 8, wherein a plurality of blades are formed around the hub and extending upwardly.

10. The fan as claimed in claim 9, wherein bottom peripheries of the blades extend axially toward the air outlet of the fan and exceed a top periphery of the side wall of the base.

11. The fan as claimed in claim 1, wherein the magnetic member is a permanent magnet.

12. The fan as claimed in claim 1, wherein the bushing comprises metal.

13. The fan as claimed in claim 1, wherein a protruding periphery is formed on center of a top surface of the hub to define a recess, and the shaft is received in the recess.

14. The fan as claimed in claim 1, wherein the stator further comprises at least one silicon steel wound by coils or a bobbin wound by coils, all of which are disposed around the magnetic member.

15. The fan as claimed in claim 1, wherein the stator further comprises a coil and a metal casing covering the coil.

16. The fan as claimed in claim 15 wherein the coil is fixed on a rack.

17. A fan, comprising:

a fan frame comprising a base;

a rotor comprising a hub, a bushing and a magnetic member sleeving on the bushing; and a stator disposed on the base and coupled with the rotor, the stator comprising a shaft through the bushing, wherein an end of the shaft is fixed on the base, wherein a plurality of ribs are formed between the base and an exterior wall of the fan frame and extending upwardly.

18. The fan as claimed in claim 17, wherein a plurality of blades are formed around the hub and extending upwardly.

19. The fan as claimed in claim 18, wherein bottom peripheries of the blades extend axially toward the air outlet of the fan and exceed a top periphery of the side wall of the base.

20. A fan, comprising:

a fan frame comprising a base;

a rotor comprising a hub, a bushing and a magnetic member sleeving on the bushing; and a stator disposed on the base and coupled with the rotor, the stator comprising a shaft through the bushing, a coil, and a metal casing covering the coil, wherein an end of the shaft is fixed on the base.

21. The fan as claimed in claim 20 wherein the coil is fixed on a rack.

* * * * *